US007871287B2

(12) United States Patent
Hofmann et al.

(10) Patent No.: US 7,871,287 B2
(45) Date of Patent: Jan. 18, 2011

(54) BRANCHING DEVICE FOR AN ELECTRIC LINE

(75) Inventors: Gerd Hofmann, Eberbach (DE); Reiner Naumann, Mannheim (DE)

(73) Assignee: Cooper Crouse-Hinds GmbH, Soest (DE)

( * ) Notice: Subject to any disclaimer, the term of this patent is extended or adjusted under 35 U.S.C. 154(b) by 732 days.

(21) Appl. No.: 10/518,907

(22) PCT Filed: Mar. 3, 2003

(86) PCT No.: PCT/EP03/02158

§ 371 (c)(1),
(2), (4) Date: Oct. 21, 2005

(87) PCT Pub. No.: WO04/001905

PCT Pub. Date: Dec. 31, 2003

(65) Prior Publication Data

US 2006/0121772 A1 Jun. 8, 2006

(30) Foreign Application Priority Data

Jun. 25, 2002 (DE) ..... 202 09 835 U

(51) Int. Cl.
*H01R 4/26* (2006.01)
*H01R 11/20* (2006.01)

(52) U.S. Cl. ..... 439/417; 439/404

(58) Field of Classification Search ..... 439/404, 439/417, 418, 396–400, 465, 271, 274, 275, 439/217

See application file for complete search history.

(56) References Cited

U.S. PATENT DOCUMENTS

| | | | | |
|---|---|---|---|---|
| 4,412,374 | A | 11/1983 | Forberg et al. | |
| 4,539,748 | A | 9/1985 | Brown et al. | |
| 5,078,617 | A | 1/1992 | Gutierrez et al. | |
| 5,257,945 | A * | 11/1993 | Heng et al. | 439/406 |
| 6,019,627 | A * | 2/2000 | Embo et al. | 439/417 |
| 6,071,145 | A * | 6/2000 | Toly | 439/465 |

FOREIGN PATENT DOCUMENTS

| | | |
|---|---|---|
| EP | 0 717 461 A1 | 6/1996 |
| EP | 0 982 804 A2 | 3/2000 |
| GB | 1 524 901 | 9/1978 |
| WO | WO 97/50151 | 12/1997 |

* cited by examiner

*Primary Examiner*—Felix O. Figueroa
(74) *Attorney, Agent, or Firm*—Fish & Richardson P.C.

(57) ABSTRACT

A branching device for at least one electric line exhibits branching contacts and a housing in which at least one electrically conducting wire terminal is accommodated in a holder. The device is characterized in that contact lips with cutting edges for cutting through the insulation of the wires of the electric line are provided on the wire terminals in that the wire terminals represent the branching contacts and in that a through-channel for the uninterrupted passage of a wire is provided in each wire terminal.

22 Claims, 3 Drawing Sheets

BRANCHING DEVICE FOR AN ELECTRIC LINE

CROSS-REFERENCE TO RELATED APPLICATION

Figure 1:
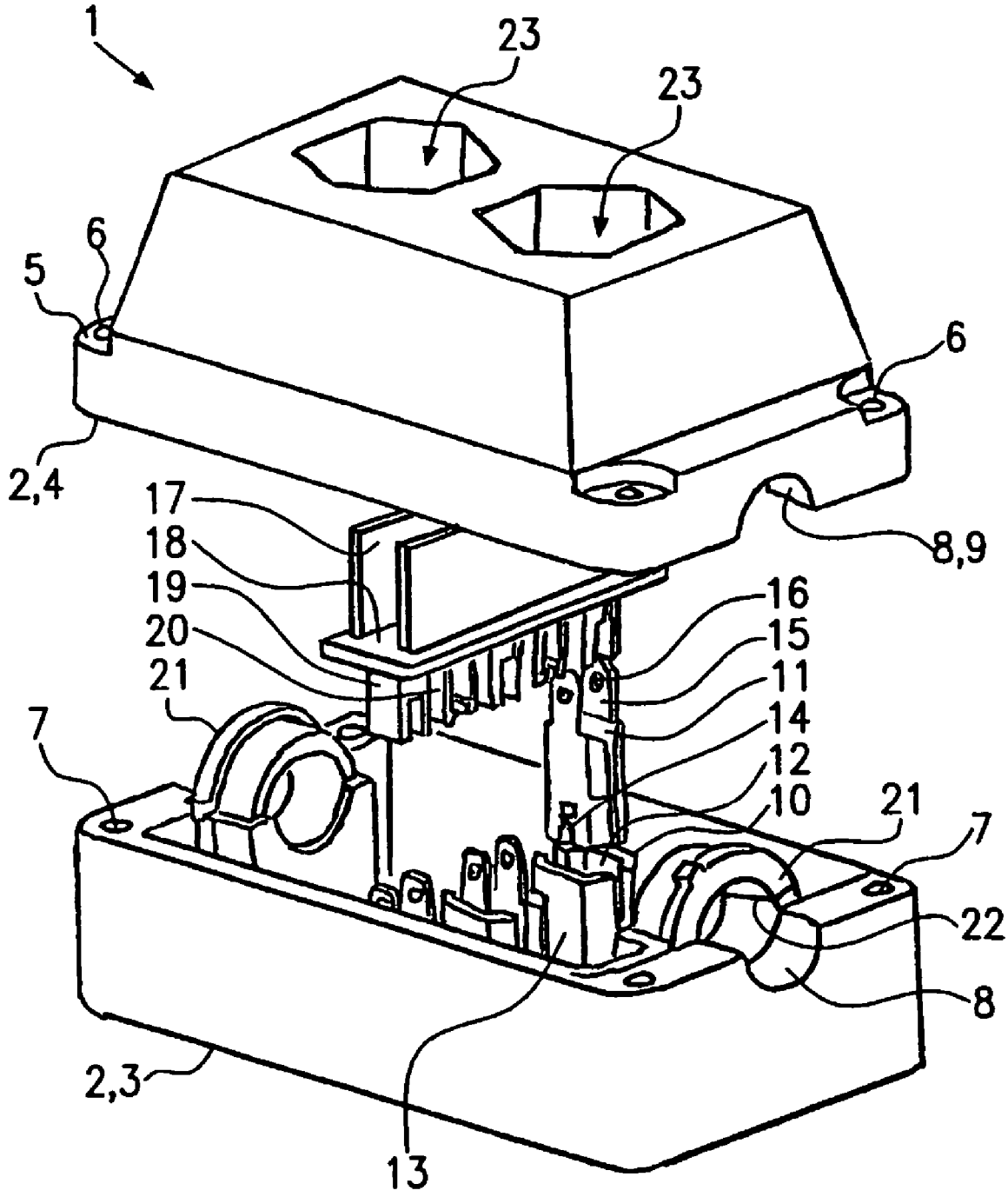

This application is a U.S. National Phase Application of PCT Application Serial No. PCT/EP2003/0002158, filed on Mar. 3, 2003, now pending, which is an International Application based on German Application No. 202 09 835.4, filed on Jun. 25, 2002, all of which are incorporated by reference.

This invention relates to a branching device for at least one electric line according to the generic term of Claim 1.

Normally in the planning of buildings, the supply lines for power, data, mains water and waste water are also planned. Primarily with industrial structures it often happens however that too few branching boxes are provided and further branches must be installed later. For the retrofitted installation of electric lines, for example cables for data links or for the supply of energy, existing lines must be interrupted and in addition fitted with new branching boxes. The disadvantage with the installation of known branching boxes is that the lines in the region of the branches are too short, because the connection points must be located within the branching boxes. Normally therefore, the electric line is parted and the now free ends of its wires are accommodated individually in wire terminals in the branching box. The retrofitted installation therefore involves a great deal of work and is expensive.

The object of this invention is to provide branching devices for electric lines, with which line branches compared to conventional branching devices are especially easier to install or to retrofit.

This object is solved by a branching device with the features of Claim 1.

Using such a branching device, a line branch can be installed quickly, economically and safely. To do this, only the outer insulation of the line is removed before the wires are pressed individually into the through-channel in their respective wire terminals from above. On inserting the wire into the through-channel the contact lips with their cutting edges penetrate the wire insulation, thus providing an electrical contact between the wire and the wire terminal. The wires therefore no longer need to be cut off in the region of the branch according to the invention and reinstalled at their ends. So it no longer occurs that the wires in the branching device are too short. In addition, only the wire insulation is penetrated, whereas its conducting core runs uninterrupted through the through-channel. Consequently, the tensile capability of the wire is retained, which signifies an enormous gain in safety.

It is particularly practicable when the through-channel runs in a straight line through the wire terminal (cord clamp). In this case the material stress is the lowest for the wire, because it is not or only slightly stretched.

Advantageously, the wire terminals (cord clamps) are accommodated loosely in the holder in the housing. Then they can be easily exchanged, for example to insert wire terminals of a different type with a wider or narrower through-channel.

A type of branching device is preferred with which at least a number of wire terminals is provided corresponding to the number of wires to be branched, so that each wire in the electric line can be accommodated in its own wire terminal.

It is conceivable that on one wire terminal at least one connecting lug is provided. This may be of a known type and be used for fastening the branching contact and for electrical connection to the branched wire.

It has been found advantageous to provide the contact lips in pairs on a wire terminal. The paired contact lips can then form the through-channel for the wire between them and ensure that the wire insulation is penetrated from both sides.

Preferably the distance between two paired contact lips is not greater than the diameter of a wire. This ensures that the cutting edges of the contact lips actually cut the wire insulation through to the conducting core, establishing contact to this conducting core.

The edges of paired contact lips facing the through-channel can for example run parallel to one another in sections. In this region the conducting core of the wire is held without it sliding out to one side of the through-channel.

In order to be able to insert the wires easier into their wire terminals, two paired contact lips can form with one another an entry section for the wire in that the distance between the contact lips widens towards an entry side of the through-channel. In this way the contact lips form together a funnel on their entry side into which the wire can be placed and positioned before being pressed into the through-channel.

Preferably at least one of the contact lips is flexible in a direction aligned away from the through-channel so that it allows a widening of the through-channel. This means it can adapt itself to the diameter of the conducting wire core and firmly clamp it in the through-channel due to its restoring force.

A notch can be provided between the wire terminal and its holder. Then the wire terminal can be fastened in the holder before retrofitting the branch. This is especially of advantage when the branching box is to be mounted overhead and the wire terminals would otherwise drop out of their holder.

Further, there is also the possibility of forming the holder of the wire terminals so that it is attached releasably on the housing. The holder can then be replaced, for example, if wire terminals for a different type of wire are needed.

A branching device, with which a common holder for all wire terminals is provided, is particularly easy to install. Then all wire terminals can be removed from or inserted into their common holder all at once.

In a preferred variation of the invention at least one holding-down clamp for the wires is provided which holds the wires in the through-channels of the wire terminals. After the installation of the branch the holding-down clamp prevents the wires from becoming unintentionally released from the through-channels and being able to interrupt the electrical contact.

It is also conceivable that at least one common holding-down clamp is provided for all wires. After placing the wires into the through-channels of the wire terminals, all wires in the electric line can then be fastened all at once. This simplifies the fitting of the branch. The holding-down clamp(s) can, for example, be formed such that they represent a closing off of the openings formed between the contact lips. The insertion of the holding-down clamp in particular closes the through-channels so that the wires cannot come loose from the through-channels.

Preferably the holding-down clamp(s) are latchable with the holder of the wire terminals. If the line has to be replaced at some time, then the holding-down clamp and wire terminal holder can be replaced quickly together. Moreover, the holding-down clamp is fastened during the installation of the branching device.

To fasten the holding-down clamp in this way, the holding-down clamp(s) can also be latchable directly with the housing.

It has proven practicable if the holding-down clamp exhibits a transverse plate, having holes and closing off the through-channels, and through which the connecting lugs of the wire terminals protrude. The transverse plate then provides separation between the region of the through-channels and the region of the connecting lugs and ensures that the branched lines are mounted at the intended positions on the wire terminals.

There is the possibility that seals are provided on the housing at the outlets for the line. In particular in dirty or damp environments the seals prevent the ingress of foreign particles into the branching device, which may have been able to impair its operation.

The seals can for example be formed as sealing rings with a side notch for inserting the line. This type of sealing ring is particularly easy to install as a single-part element.

Preferably the housing of the branching device can be put together from a housing base section and a housing upper section. Then during the installation of the branch, for example, first the wires can be accommodated in the wire terminals provided in the housing base section before the housing upper section is placed on top as a protective cap.

In order to be able to better fasten the housing base section and the housing upper section together, they can in particular be screwed together.

In order to increase safety, strain-relief can be provided on the housing of the branching device at the outlets for the line. This can, for example, be realised in that the lines are firmly clamped at the outlets. Consequently, the transfer of the tensile force on the parts contained in the branching device is prevented, in particular to the wire terminals.

In the following two advantageous embodiments of the branching device according to the invention are presented based on a drawing.

Figure 2:
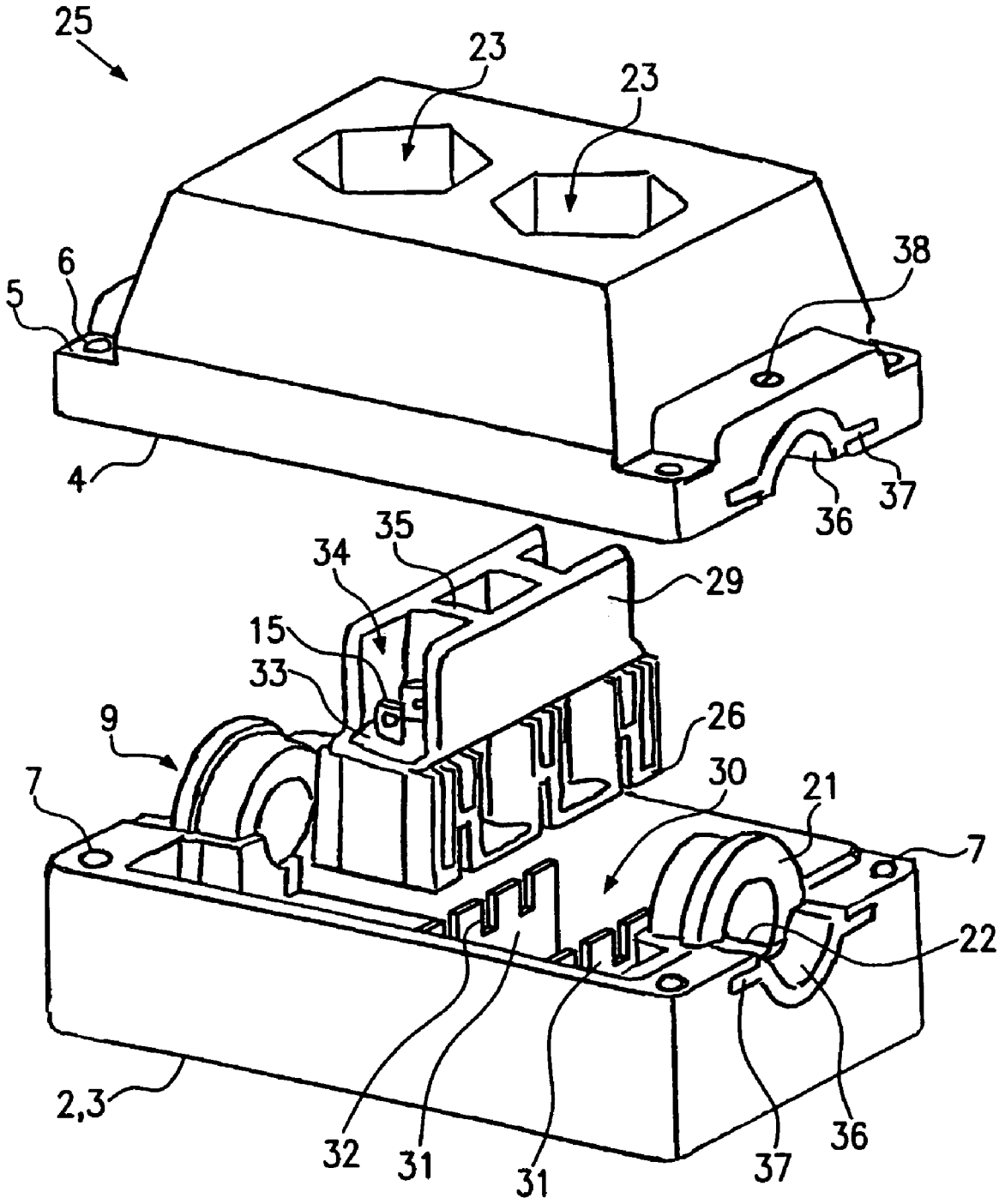
Figure 3:
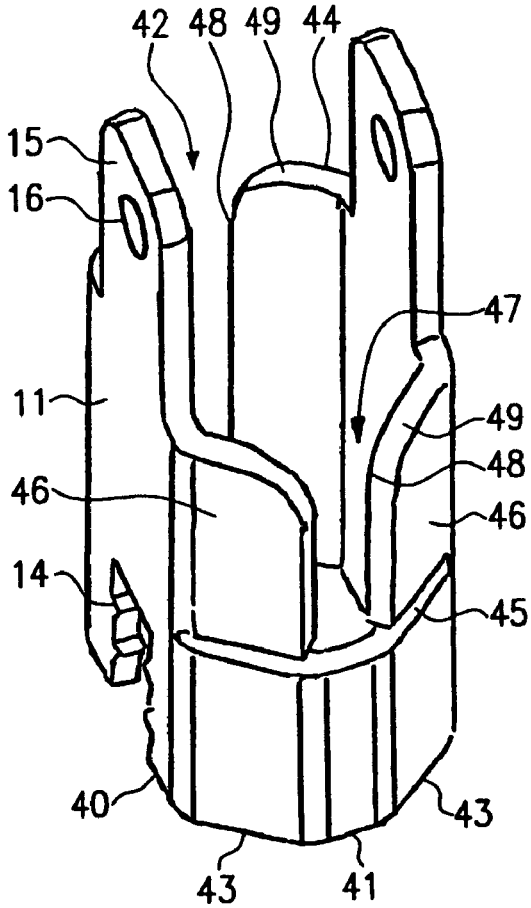
Figure 4:
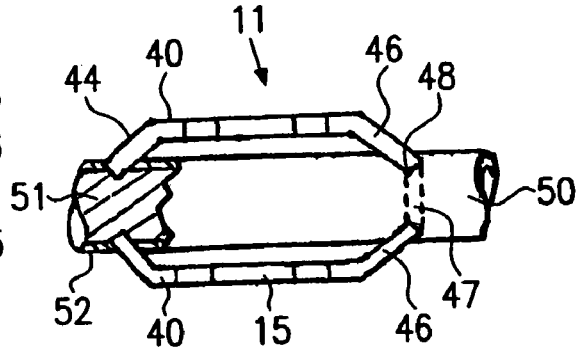
Figure 5:
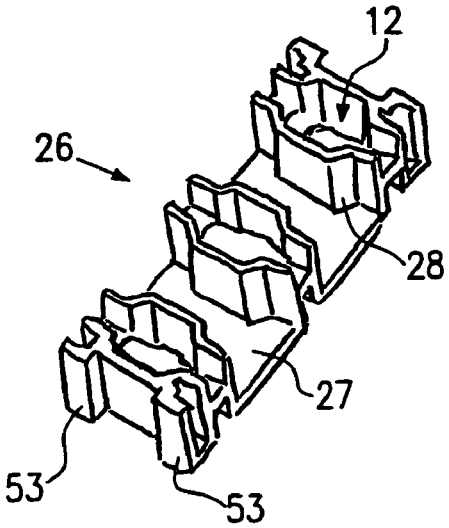
Figure 6:
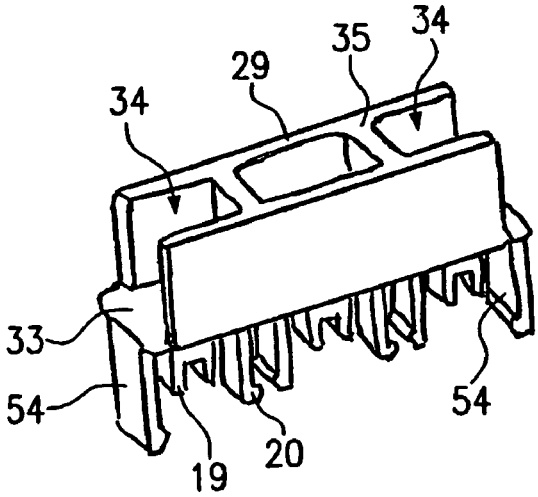

In detail the following are shown:

FIG. 1 a perspective view of a first embodiment of a branching device according to the invention, FIG. 2 a perspective view of a second embodiment of a branching device according to the invention, FIG. 3 a perspective view of a wire terminal (cord clamp) which can be used in the branching device according to the invention, FIG. 4 a partially sectioned plan view of the wire terminal (cord clamp) with inserted wire, FIG. 5 a perspective view of a holder for the wire terminals, and FIG. 6 a perspective view of a holding-down clamp.

FIG. 1 shows a first embodiment of a branching device 1 according to the invention. It exhibits a housing 2, which can be assembled from a housing base section 3 and a housing upper section 4. The two housing sections 3, 4 can be formed from one plastic material, for example by injection moulding. In the plan view the two housing sections 3, 4 have an approximate rectangular cross-section. The housing upper section 4 can be screwed to the housing base section 3. For this, through openings 6 are provided on side shoulders 5 at each of the four corners of the housing upper section 4. On placing the housing upper section 4 onto the base section 3, these openings 6 align with holes 7 in the housing base section 3. Internal threads are provided in these holes 7 in which a screw inserted through the openings 6 can engage.

On the short sides of their rectangular cross-sections semicircular recesses 8 are provided both in the housing base section 3 and in the housing upper section 4. The recesses 8 are arranged such that circular openings 9 are formed on assembling the housing. These are the outlets 9 through which a line (not shown) is brought out and into the housing 2.

In the housing base section 3 three holders 10 for wire terminals (cord clamps) 11 are mounted. In this embodiment the holders 10 are permanently joined to the housing base section 3, for example, by a single-part formation. Each holder 10 defines an eight-sided locating space 12 in which a wire terminal 11 can be inserted from above. The location space 12 is bounded by two side walls 13 which each have an approximate U-shaped cross-section. The walls 13 of the holder 10 are arranged such that a straight through-channel is formed between them, which is essentially parallel to the longitudinal axis of the housing 2. On the inside of the location space 12 latching elements (not shown), which can be latched into the notches 14 in the wire terminals 11, are located in the holder 10. In this way the wire terminal 11 can be held releasably in the holder 10.

Each wire terminal (cord clamp) 11 is used for the accommodation of one single wire of an electric line. The illustrated embodiment of a branching device 1 can therefore be used for branching electric lines with up to three wires.

The branching device 1 is illustrated in a state in which two wire terminals 11 are inserted into two of the holders 10. Connecting lugs 15 on the wire terminals 11 protrude above the top of the holders 10. The shape of the connecting lugs 15 as such is known. They have centrally a through-hole 16 through which a wire to be branched can be passed.

A third wire terminal 11 is shown outside of its holder 10. The exact shape and functioning principle of the wire terminals 11 is described based on FIGS. 3 and 4.

A holding-down clamp 17 can furthermore be seen in FIG. 1. Its length corresponds approximately to the internal width of the housing base section 3. The holding-down clamp 17 exhibits a transverse plate 18 which lies on the top of the holders 10 parallel to the bottom of the housing base section 3, once the holding-down clamp has been inserted. In the transverse plate 18 longitudinal openings (not shown) are provided through which the connecting lugs 15 of the wire terminals 11 can protrude.

Three wire guides 19 protrude from the underside of the transverse plate 18 and between them two latching elements 20 protrude. The wire guides 19 are positioned such that they protrude into the inner space of the wire terminals 11 when the holding-down clamp 17 is inserted. Each wire guide 19 has the shape of an inverted U, between the two legs of which a wire can be passed. In the assembled state the bottom of the U-shaped wire guide 19 provides a spacing of the wire from the transverse plate 18 of the holding-down clamp 17. To obtain this spacing, the wire must be pressed into the wire terminal 11. The latching elements 20 each have a cross-section corresponding to two "L" shapes facing one another. On inserting the holding-down clamp 17 into the housing 2, they can latch with corresponding latching elements between the holders 10 on the housing base section 3. In this way the holding-down clamp 17 is held releasably on the housing base section 3.

In the housing base section 3 sealing rings 21 are furthermore mounted which align with the recesses 8. The sealing rings 21, which for example are formed from rubber, provide sealing for the assembled housing 2 with respect to the housing external environment. Consequently, they prevent the ingress of dirt and moisture into the interior of the housing. Each sealing ring 21 exhibits a side cut 22. Due to the flexibility of the sealing rings 21, they can be opened at the cut 22 in order to permit the insertion of a line into the sealing ring 21. The flexibility of the material leads to them fitting snugly around the electric line when the housing base section 3 is assembled with the housing upper section 4. Here, the sealing rings 21 can even be partially compressed to increase their sealing effect.

Two indentations 23 are provided in the top of the housing upper section 4. They are each used for the accommodation of the end of a line to be branched, the wires of which can be passed through openings in the bottom of the indentation 23 into the interior of the housing 2 so that they can be connected to the connection contacts formed as connecting lugs 15. The indentations 23 have a hexagonal cross-section. The branching device 25 could also be formed such that corresponding connecting plugs for the branched line with a hexagonal outer shape can be plugged into the hexagonal indentations 23.

FIG. 2 shows a second embodiment of a branching device 25 according to the invention. Parts, which match those of the branching device 1, are designated with the same reference symbols. The main difference with respect to the first embodiment is that with the branching device 25 a common holder 26 for all three wire terminals 11 is provided. This holder 26 is illustrated separately based on FIG. 5. The holder 26 consists of a single-part component of an insulating material, for example plastic. It has a base plate 27, from the upper side of which walls 28 protrude at right angles, which each form in pairs a locating space 12 between them for a wire terminal 11. The walls 28 are formed and arranged such that the locating space 12 formed between them can accommodate an essentially octagonal wire terminal 11.

In contrast to the first embodiment, with the branching device 25 the wire terminal holder 26 and a holding-down clamp 29 can be latched together directly before they are inserted together in a corresponding recess 30 in the housing base section 3. The recess 30 is formed by two transverse walls 31 which accommodate the holder 26 closely between them. On the top of the transverse walls 31 slots 32 are formed to provide guidance for the wires.

FIG. 2 shows the branching device 25 in a situation in which the holder 26 and the holding-down clamp 29 are latched together. In addition the two connecting lugs 15 of a wire terminal 11 (cord clamp) which protrude upwards above a transverse plate 33 of the holding-down clamp 29 can be seen. The connecting lugs 15, which here represent the branching contact, are therefore located in a connecting lug compartment 34 on the upper side of the holding-down clamp 29. Each connecting lug compartment 34 is assigned to a single wire terminal 11 and is separated from the other connecting lug compartments 34 by insulating partitions 35. These reduce the risk of an electrical short circuit between adjacent wires.

Another difference to the first embodiment is that with the branching device 25 strain relief is provided on each outlet 9 on the housing 2. This strain relief includes semi-circular clamping pieces 36 of a hard plastic, which are inserted into each recess 8 on the housing base section 3 or on the housing upper section 4. Wing sections 37 protrude to the sides of the clamping pieces 36. On assembling the branching device 25 the clamping pieces 36 are inserted with their wings 37 into corresponding grooves on the housing sections 3, 4 and thus fastened with respect to the housing 2. An adjusting screw 38 is assigned to at least one of the paired clamping pieces 36. It is accessible from the outside of the housing 2—in the illustrated embodiment from the outside of the housing upper section 4. When this adjustment screw 38 is tightened, it moves the two clamping pieces 36 that are associated to one another closer together. A cable, i.e. the electric line, lying between the two clamping pieces 36 is then clamped by the clamping pieces 36. If now a pull on the cable occurs from outside, then the tension is transferred to the housing 2 of the branching device 25 by the clamping pieces 36, instead of, for example, leading to the wires being pulled from their wire terminals 11 inside the housing.

The illustrated branching devices 1, 25 are each suitable for branching two new lines from an electric line with up to three wires.

In FIG. 3 a wire terminal 11 is shown which can be used in the branching devices 1, 25 according to the invention. It is of one piece made from a conducting material, for example a metal and exhibits a constant wall thickness. It can consequently be produced, for example by bending, from a flat piece of metal.

The outline of the wire terminal 11 is approximately octagonal with two opposing long side walls 40 and two short sides 41, 42 orthogonal to them. The diagonal sides 43 extend between the short side 41 and the long sides 40. Analogously, the diagonal sides 44 extend between the short side 42 and the long sides 40.

The long sides 40 are mirror images of one another. Their top section forms in each case a connecting lug 15 with a central through hole 16. At the lower end of the side wall 40 there is a cut-out which laterally exhibits notches 14 formed as latching shoulders. They are used for latching the wire terminal 11 to the holder 10, 26.

The short side 41 is divided into a bottom section and a top section, which are separated from one another by a horizontal cut 45. The cut 45 extends over the short side 41 and the adjacent diagonal sides 43. The bottom section of the short side 41 forms the connection between the two sides of the wire terminal 11. The top sections of the two diagonal sides 43 form in each case a contact lip 46. Due to the cuts 45, the contact lips 46 have a certain flexibility and can be moved in particular with respect to the bottom section of the diagonal sides 43. The short side 41 is open between the two contact lips 46 and hence forms a through-channel 47 open at the top. The opposing walls of the paired contact lips 46 run vertically and parallel to one another in this region. Since the contact lips 46 are located diagonally to the short side 41, but are cut off perpendicular to their outer surfaces, the narrowest point of the through-channel 47 is determined by the two parallel edges 48. Since the tips of these edges 48 protrude into the through-channel 47, they represent cutting edges to a wire to be laid into the through-channel 47. In an upper section of the contact lips 46 the spacing between them widens towards an entry side of the through-channel 47. In this region the paired contact lips 46 form an entry section 49 which guides the wire in like a funnel during insertion into the through-channel 47.

On the short side 42 the wire terminal 11 is completely open, so that this side of its octagonal outline is free. The adjacent diagonal sides 44 of the wire terminal 11 also represent contact lips, between which the through-channel 47 for the wire runs. Sine the sides 41 and 42 are exactly opposite, the through-channel 47 overall passes straight through the wire terminal 11. The contact lips 44 are, apart from larger height, cut exactly as the contact lips 46. Therefore, they, too, exhibit cutting edges 48, the tips of which protrude into the through-channel 47. Apart from an upper entry section 49, they run vertically and parallel to one another.

In FIG. 4 a wire terminal 11 is shown with a wire 50 inserted in it. It has a conducting metal core 51 and an insulation 52 consisting of soft plastic. The wire 50 has been pressed from above into the through-channel 47 via the entry section 49. On the left side it can be seen in section that the contact lips 44, 46 have with their cutting edges cut through the insulation 52 and cut into the conducting core 51 of the wire 50, because the spacing between the cutting edges 48 is smaller than the diameter of the metal core 51. In this way an electrical contact between the metal core 51 and the wire terminal 11 has been made.

The single-piece holder 26 shown in FIG. 5 has already been explained in conjunction with the description of FIG. 2. Since the locating spaces 12 for the wire terminals 11 have a somewhat longitudinally extensive shape, corresponding to that of the wire terminals 11, they define the orientation in which the wire terminals 11 can be inserted into the holder 26. This is only possible in an orientation for which the through-channels 47 of the wire terminals 11 run orthogonally to the holder 26, i.e. orthogonally to its base plate 27.

At each of the four corners of the holder 26 protrusions 53 are formed. The spacing between two adjacent protrusions 53 is just as large or slightly larger than the width of a latching lip 54, which (as shown in FIG. 5) protrudes downwards on the holding down clamp 29 orthogonally from the transverse plate 33. The latching lip 54 is so long that it extends over the holder 26. Alternatively, the latching lip 54 could also be latchable in a side groove or indentation on the holder 26. The other elements of the holding-down clamp 29 shown in FIG. 6 have already been described in conjunction with FIG. 1 or 2, in particular the U-shaped wire guides 19, the latching elements 20, the three connecting lug spaces 34 or the partitions 35 located between them.

For the installation of a line branch, first the housing 2 of the branching device 1 resp. 25 is opened. The insulation of the electric line is removed over the length of the housing 2, before it is inserted through the cuts 22 in the sealing rings 21. Each wire 50 of the electric line is placed individually into a wire terminal 11 held in a holder 10, 26, so that the wire 50 lies on the two entry sections 49, open upwards, of the through-channel 47.

In the next step the holding-down clamp 17, 29 is put into place from above. The pressing down of the holding-down clamp 17, 29 causes the wire 50 to be grasped by the U-shaped wire guide 19 and forced into the through-channel 47. In doing so, the cutting edges 48 cut through first the insulation 52 of the wire 50. Once the wire 50 has been pushed deep enough into the through-channel 47, the cutting edges 48 cut into the conducting core 51 of the wire 50, thus establishing the electrical contact between the wire 50 and the wire terminal 11. Finally, the holding-down clamp 17, 29 is seated on the holder 10, 26 and closes off the through-channels 47 at the top. Once the holding-down clamp 17, 29 is latched with the housing base section 3 and the holder 10, 26, it is ensured that the connecting lugs 15 of the wire terminal 11 protrude far enough above the top of the transverse plate 18, 33 of the holding-down clamp 17, 26. In particular the connecting lugs 15 protrude so far above the transverse plate 18, 33 that the through holes 16 in the connecting lugs 15 are free. They therefore form the connecting contacts to which the wires of the lines to be branched and passed through the indentations 23 can be connected.

Once this connecting contact has been made and the holder 26, wire terminals 11 and holding-down clamp 17, 29 are arranged in the housing base section 3, the housing 2 can be closed. To do this, the housing upper section 4 is placed on the housing base section 3 and screwed together with the housing base section 3 through the aligned openings 6, 7. To provide the strain relief the adjustment screws 38 are also tightened until the clamping pieces 36 clamp together the electric line with a sufficiently high force. Finally, the branching device 1, 25 can be mounted in the building.

The branching devices according to the invention can deviate in many ways from the described embodiments of the branching devices 1 and 25. For example, to branch electric lines with more or less wires, appropriately more or less wire terminals 11 can be provided. These can, as in the devices 1 and 25, be arranged adjacently; they could however also be arranged offset from one another to save space. In this respect all variants of fixed holders 10 or releasable holders 26 are conceivable.

Also the number of branched lines does not have to be two. Just as well, a single branched line could be produced or also the possibility for three or more branched lines could be provided. In addition branching devices are conceivable with which branching from more than one electric line occurs parallel to one another. Overall the combination n·m·k, where n is the number of entering electric lines, which each exhibit m wires and k branched electric lines, is almost freely selectable. For each of the n electric lines preferably dedicated housing outlets 9, sealing rings 21 and strain relief with clamps 36 would be provided.

According to the number k of branched lines also more or fewer connecting lugs 15 can be provided per wire terminal 11.

The holding-down clamp 17, 29 must not necessarily be formed as a common holding-down clamp for all wire terminals 11. It is conceivable that also individual holding-down clamps, which each hold down one individual wire 50 in their wire terminal 11, could be used.

Instead of running parallel to one another, paired cutting edges 48 could also be formed concave, so that the spacing widens between them in the centre of the concave shape. When a wire 50 is inserted, the contact lips 46 would widen slightly due to their flexibility. Once the wire lies in the concave part, the contact lips 46 close around the wire which is then securely held in the concave part.

Finally, the housing 2 could also be formed as a single part whereby the housing parts could be made movable by a hinge, e.g. a film hinge.

The invention claimed is:

1. A branching device for at least one electric line, the branching device comprising:

a housing comprising a housing base section and a housing upper section to be connected with each other;

at least one electrically conducting wire terminal that provides a branching contact is accommodated in a holder, and includes contact lips with cutting edges for cutting through insulation of a wire to be connected to the wire terminal;

wherein the at least one wire terminal further includes at least one connecting lug, a through-channel for the uninterrupted passage of the wire, and at least one holding-down clamp which holds the wires in the through-channel of the wire terminal and which is inserted in the housing;

at least one of the contact lips is located diagonally to the through-channel so that the tip of the edge of the contact lip protrudes into the through-channel;

at least one of the contact lips is flexible in a direction pointing away from the through-channel; and the holding-down clamp exhibits a transverse plate that closes off the through-channel and has an opening through which the connecting lug of the wire terminal protrudes.

2. A branching device according to claim 1, wherein the wire terminal exhibits a generally octagonal outline with two opposing longer sides, two shorter sides orthogonal to the longer sides, and diagonal sides situated between the longer and shorter sides, and wherein the holder includes a corresponding octagonal locating space for accommodating the wire terminal.

3. A branching device according to claim 1, wherein the contact lips are generally aligned with the diagonal sides of the wire terminal.

4. A branching device according to claim 1, wherein the through-channel runs in a straight line through the wire terminal.

5. A branching device according to claim 1, wherein the wire terminal is accommodated releasably in the holder.

6. A branching device according to claim 1, wherein the device includes a number of wire terminals corresponding to at least a number of wires to be branched.

7. A branching device according to claim 1, wherein the contact lips are provided in pairs in each case on a wire terminal.

8. A branching device according to claim 7, wherein the spacing between two paired contact lips is less than or equal to the diameter of a wire to be connected to the wire terminal.

9. A branching device according to claim 7, wherein the edges of paired contact lips facing the through-channel run parallel to one another at least in sections.

10. A branching device according to claim 7, wherein two paired contact lips together form an entry section for the wire, with a spacing between the contact lips widening towards an entry side of the through-channel.

11. A branching device according to claim 1, wherein a notch is provided between the wire terminal and its holder.

12. A branching device according to claim 1, wherein the holder of the wire terminals is attached releasably to the housing.

13. A branching device according to claim 1, further comprising multiple wire terminals and a common holder for all of the wire terminals.

14. A branching device according to claim 1, further comprising at least one common holding-down clamp for all wires.

15. A branching device according to claim 1, wherein the holding-down clamp represents a closure of the openings formed between the contact lips.

16. A branching device according to claim 1, wherein the holding-down clamp can be latched to the holder of the wire terminal.

17. A branching device according to claim 1, wherein the holding-down clamp can be latched to the housing.

18. A branching device according to claim 1, wherein seals are provided on the housing at the outlets for the line.

19. A branching device according to claim 18, wherein the seals are formed as sealing rings with a side cut for inserting the line.

20. A branching device according to claim 1, wherein the housing is assembled from a housing base section and a housing upper section.

21. A branching device according to claim 20, wherein the housing base section and the housing upper section can be screwed together.

22. A branching device according to claim 1, wherein strain relief is provided on the housing at the outlets for the lines.

* * * * *